US005144899A

United States Patent [19]

Allen

[11] Patent Number: 5,144,899

[45] Date of Patent: Sep. 8, 1992

[54] COMBINATION EMBROIDERY/SCREEN PRINTING APPARATUS AND METHOD

[76] Inventor: Michael N. Allen, 532 Elizabeth, Kansas City, Kans. 66101

[21] Appl. No.: 669,190

[22] Filed: Mar. 14, 1991

[51] Int. Cl.[5] ..... D05C 9/04; B41F 15/06

[52] U.S. Cl. ..... 112/103; 112/262.3; 112/266.1; 101/114; 101/129

[58] Field of Search ..... 112/103, 121.12, 266.1, 112/262.3, 439, 262.1; 101/114, 129, 126, 127.1, 128.1, 115

[56] References Cited

U.S. PATENT DOCUMENTS

| | | | |
|---|---|---|---|
| 3,664,288 | 5/1972 | Von Boden | 112/103 |
| 3,738,299 | 6/1973 | Packler et al. | 122/439 |
| 3,964,408 | 6/1976 | Smith | 112/80.23 |
| 3,974,010 | 8/1976 | Cox, Jr. | 112/439 X |
| 4,052,945 | 10/1977 | Leetz | 112/86 X |
| 4,315,461 | 2/1982 | Harpold | 101/115 |
| 4,485,574 | 12/1984 | Bennetot | 112/103 X |
| 4,526,116 | 7/1985 | Mannel | 112/266.1 |
| 4,587,910 | 5/1986 | Raines | 112/121.12 |
| 4,598,488 | 7/1986 | Inteso | 112/103 X |
| 4,640,529 | 2/1987 | Katz | 112/439 X |
| 4,762,076 | 8/1988 | Wakaizumi | 112/103 |
| 4,774,778 | 10/1988 | Williams | 112/78 X |
| 4,831,753 | 5/1989 | Inteso | 112/103 X |
| 4,849,902 | 7/1989 | Yokoe et al. | 112/121.12 X |
| 5,005,219 | 4/1991 | Diaz | 112/266.1 X |

OTHER PUBLICATIONS

Brochure-Barudan Co., Ltd, Ichinomiya-city, Japan; BEMR Series Computer-Controlled Embroidery Machine.

*Primary Examiner*—Peter Nerbun

*Attorney, Agent, or Firm*—Litman, McMahon & Brown

[57] ABSTRACT

A combination embroidery/screen printing apparatus and method comprises an inner hoop cooperating with an outer hoop for clamping and planarly confining a selected area of a textile substrate as a reproduction of a selected pattern is formed thereon, a framed screen for forming selected first portions of the reproduction on the selected substrate area by screen printing, a stitching machine for forming selected second portions of the reproduction on the selected substrate area by automated stitching, and an alignment mechanism including an alignment template for obtaining close registration between the printed first portions and the stitched second portions of the reproduction. The framed screen and the alignment template are shaped and dimensioned such that each can be snugly slidably removably inserted in the inner hoop. A removable target disk in conjunction with the alignment template provides alignment of the substrate relative to the clamping hoops.

10 Claims, 2 Drawing Sheets

COMBINATION EMBROIDERY/SCREEN PRINTING APPARATUS AND METHOD

FIELD OF THE INVENTION

The present invention relates to a combination embroidery/screen printing apparatus and method for forming reproductions of a pattern for decorating textiles.

BACKGROUND OF THE INVENTION

Embroidery is a commonly used technique for providing an infinite variety of singly or multiply colored stitched pattern and pictorial enhancements to wearing apparel and other articles constructed of textiles and other lightweight materials. Embroidery involves the stitching of thread into a selected cloth substrate such as a coat, sweatshirt, sheet material, or the like. By appropriately choosing various threads having different colors and by carefully intermingling such stitched threads, patterns can be created which are extremely attractive, expensive in appearance and suitable for fashionable designer apparel.

With the development of readily available and sophisticated computing hardware and software for controlling embroidery equipment and machinery, the manufacture and production of such enhanced products has been automated whereby such articles are now mass-produced at costs substantially reduced from those of articles previously produced without the benefit of such automation.

Even so, the increased capability has encouraged the production of patterns comprising extremely complex details such that the number of stitches in an embroidered pattern for a shirt or blouse may easily exceed sixty-thousand. With fully automated equipment, approximately forty-five minutes are presently required to install ten thousand stitches by a single stitcher. As a result, each such complex pattern would require the equivalent of several hours production time of a relatively expensive, specialized machine. Therefore, the selling price of such stitched articles must be substantially increased in order to recapture the associated capital investment.

Another commonly used technique for embellishing wearing apparel and other textile products is screen printing with inks compatible with textiles and their uses. Screen printing has been particularly well-adapted to the wide-spread tee shirt and sweatshirt industry due to its versatility, low initial investment, and cost-effectiveness. However, that cost-effectiveness produces diminishing returns as a greater number of individual colors are used to produce increasingly complex, multicolored patterns due to the fact that an additional production step generally must be added for each additional color.

What is needed is an apparatus and a method which cooperatively utilize screen printing techniques for large uniformly colored areas of a pattern such that substantial production and equipment time and cost savings can be realized for those portions of a particular pattern, and which utilize embroidering techniques for those portions of the pattern which are more delicately and intricately defined, thereby preserving the luxuriousness that only embroidery stitching can provide.

SUMMARY OF THE INVENTION

A combination embroidery/screen printing apparatus and method are provided to substantially concurrently reproduce a pattern on at least one textile substrate wherein a first portion of each such reproduction is screen printed and a second portion of each such reproduction is embroidered. The apparatus includes an inner hoop and an outer hoop for each such reproduction, a target disk for locating the designated center and desired orientation of each such reproduction, at least one frame having a screen for screen printing the first portion of each such reproduction, a stitching machine for embroidering the second portion of each such reproduction, at least one alignment template, and an alignment platform.

Each region of the substrate selected to receive one of the reproductions is positioned between a respective one of the inner hoops and a respective one of the outer hoops. A transparent one of the alignment templates is inserted in the respective inner hoop and the substrate is aligned therewith by aligning centrally located x-y axes inscribed on the alignment template with centrally located x-y axes inscribed on the respective target disk removably and adhesively secured to the substrate. Upon tightening the respective outer hoop against the respective inner hoop, the alignment template is removed from the respective inner hoop and the respective target disk is removed from the substrate. Respective inner and outer hoops for the other reproductions to be substantially concurrently reproduced are similarly aligned and clamped.

The first portion of each of such reproductions is then screen printed by sequentially inserting the frame into each of the respective inner hoops and outer hoops having the substrate clamped therebetween. Each of the respective inner hoops and outer hoops is then loosely mounted on a platen in side-by-side relationship. Each one of the inner hoops, in clamping relation with a respective one of the outer hoops, is then aligned with the platen by inserting the alignment template in the respective inner hoop and aligning the alignment template such that the origin of the x-y axis inscribed thereon is aligned with a first stylus slidably suspended from the alignment platform as an off-center point of the y-axis is aligned with a second stylus similarly suspended from the alignment platform. Each of the other inner hoops and outer hoops similarly mounted on the platen is similarly, sequentially aligned by aligning the first stylus and the second stylus with the alignment template inserted in the respective inner hoop.

The platen, together with the aligned inner and outer hoops fixedly mounted thereon, is mounted on the stitching machine and aligned with the alignment template. The second portion of each of such reproductions is then simultaneously stitched in the substrate areas stretchingly clamped by each of the respective inner and outer hoops mounted on the platen.

OBJECTS AND ADVANTAGES OF THE INVENTION

Therefore, the objects and advantages of the present invention are: to provide an apparatus and a method for providing a combination embroidered/screen printed pattern on a textile substrate; to provide such an apparatus and a method which provide excellent registration between embroidered portions and screen printed portions of a pattern printed on a textile substrate; to provide such an apparatus and a method which are readily adaptable to automation; to provide such an apparatus and a method which are applicable to assembly line, mass production manufacturing methods; and to generally provide such an apparatus and a method which are relatively easy to operate efficiently and reliably, economical to use, simple to maintain, and which generally perform the requirements of their intended purposes.

Other objects and advantages of this invention will become apparent from the following description taken in conjunction with the accompanying drawings Wherein are set forth, by Way of illustration and example, Certain embodiments of this invention.

The drawings constitute a part of this specification and include exemplary embodiments of the present invention and illustrate various objects and features thereof.

DETAILED DESCRIPTION OF THE INVENTION

Figure 1:
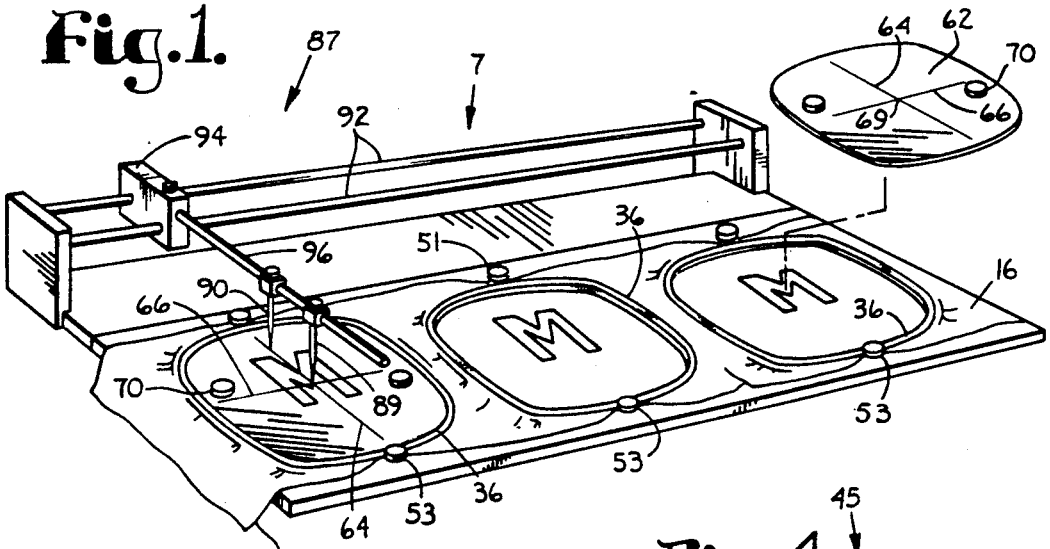
FIG. 1 is a perspective view of an alignment platform of a combination embroidery/screen printing apparatus according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a combination embroidery/screen printing apparatus in accordance With the present invention, as shown in FIGS. 1 to 8. The apparatus 1 comprises stitching means 3, screen printing means 5, and alignment means 7.

Figure 3:
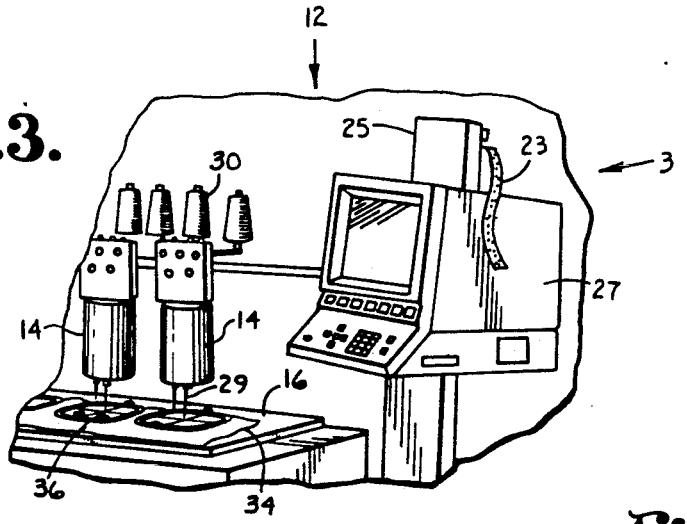
FIG. 3 is a fragmentary, perspective view of a stitching machine of the combination embroidery/screen printing apparatus.
Figure 5:
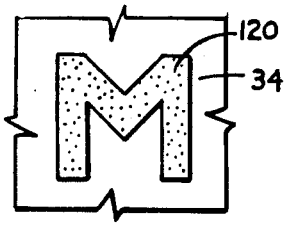
FIG. 5 is a reproduction of a pattern produced by the combination embroidery/screen printing apparatus, showing screen printed portions thereof.
Figure 6:
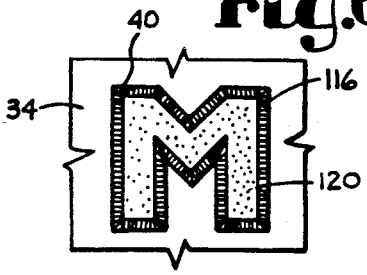
FIG. 6 is a reproduction of a pattern produced by the combination embroidery/screen printing apparatus, showing screen printed and stitched portions thereof.

The stitching means 3 includes a stitching machine, such as a Model No. BEMR-8 Embroidery Machine as provided by Barudan Co., Ltd., or other suitable equipment, as indicated by the numeral 12 in FIG. 3. The stitching machine 12 includes a plurality of side-by-side stitchers 14, substrate securement means such as a removable platen 16 and clamping means 18, and a programmed punched tape 23 in conjunction with a tape reader 25 and a computer 27 for cooperatively driving and controlling the platen 16 and the stitchers 14. The quantity of the stitchers 14 may vary from one to greater than twenty, depending on the stitching machine 12 used for a particular application. Each of the stitchers 14 includes at least one vertically oriented, reciprocating needle 29 for dispensing thread 30 for installing stitches in an underlying substrate 34 as hereinafter described.

Figure 2:
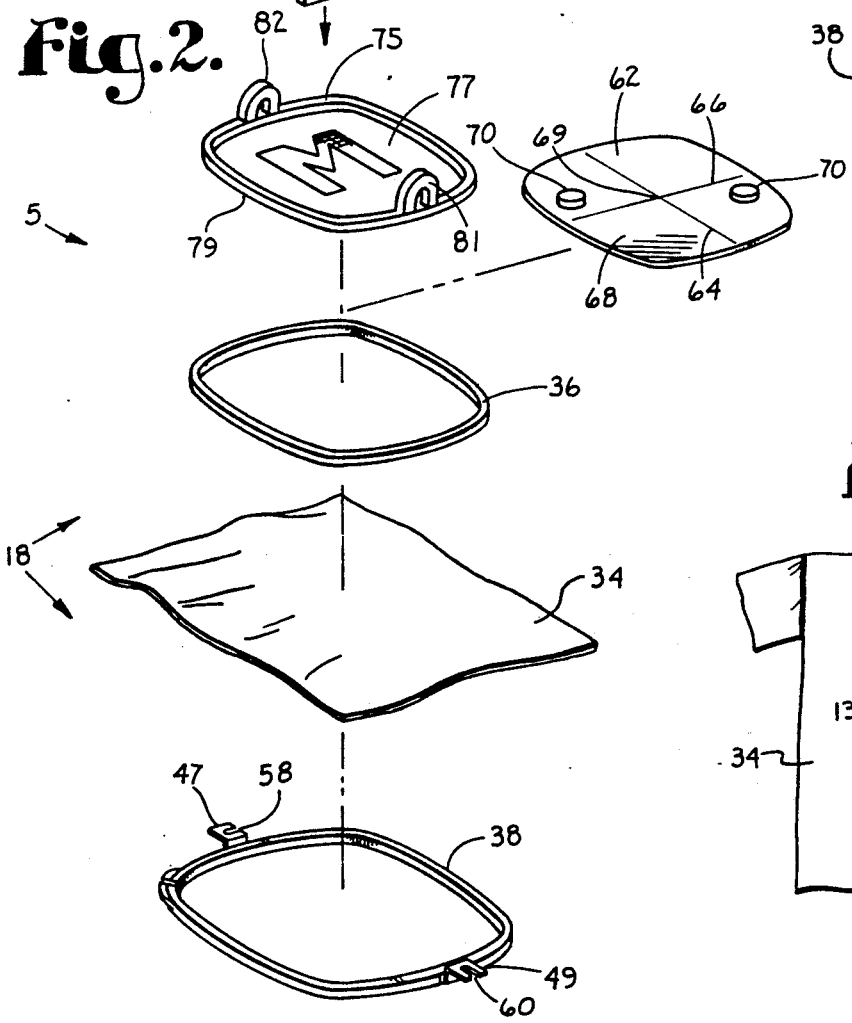
FIG. 2 is an exploded, perspective view of a screen printing portion and clamping hoops of the combination embroidery/screen printing apparatus.
Figure 8:
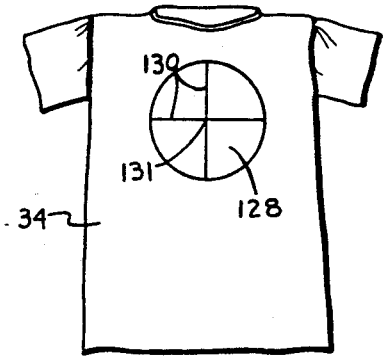
FIG. 8 is a front view of a substrate, with a target disk attached thereto, for an application of the combination embroidery/screen printing apparatus according to the present invention.

The clamping means 18 includes an inner hoop 36 and an outer hoop 38 for each one of the stitchers 14. The inner hoop 36 and the outer hoop 38 of each of the clamping means 18 can be any size and shape compatible with the stitching machine 12 but the clear dimensions contained within the inner hoop 36 must be somewhat greater than the corresponding dimensions of a reproduction 40 of a pattern to be stitched into the substrate 34. Preferably, the inner hoop 36 is rigid, has a one-piece construction, has a non-circular configuration, and is substantially planar, as indicated in FIG. 2.

Figure 4:
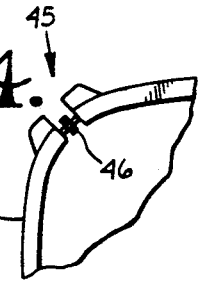
FIG. 4 is an enlarged, fragmentary plan view of an outer hoop of the combination embroidery/screen printing apparatus.

The outer hoop 38 has a configuration substantially similar to that of the inner hoop 36. The outer hoop 38 is dimensioned such that it can peripherally encircle the inner hoop 36. Then, when the outer hoop 38 and the inner hoop 36 are in clamping relation such that the substrate 34 is appropriately clamped between the inner hoop 36 and the outer hoop 38, the inner hoop 36 is substantially co-planar with the outer hoop 38. The outer hoop 38 has a gap 45, as shown in FIG. 4, such that a clamping adjuster 46, which is threadably connected to the outer hoop 38 on each side of the gap 45, can be rotated to tighten the outer hoop 38 against the inner hoop 36.

The lower hoop 38 has a pair of opposing brackets 47 and 49. A pair of knurled knobs 51 and 53, each having a threaded member extending therefrom, is provided for each of the clamping means 18 which, in conjunction with the brackets 47 and 49, provide means for threadably securing the outer hoop 38 of each of the clamping means 18 to the platen 16. The bracket 47 has a transverse slot 58 and the bracket 49 has a longitudinal slot 60. As a result, the brackets 47 and 49, in conjunction with the knobs 51 and 53, provide means to precisely rectilinearly and angularly align each of the respective outer hoops 38 with the platen 16. Although the platen 16 is shown in FIG. 1 with only three of the clamping means 18 mounted thereon, it is to be understood that the actual quantity of the clamping means 18 mounted thereon would normally correspond with the quantity of the stitchers 14 in the stitching machine 12.

A planar alignment template 62, constructed of plexiglas or other suitable material, is shaped and dimensioned substantially similarly to the inside dimensions of the inner hoop 36 such that the alignment template 62 is snugly slidably insertable therein. The alignment template 62 has a centrally situated pair of x-y axes 64 and 66 inscribed on a front face 68 thereof such that the axes 64 and 66 intersect perpendicularly at the center of the alignment template 62, as designated by the numeral 69 and as shown in FIG. 2.

One or more lifters 70 are secured to the face 68 of the alignment template 62 to assist with the removal of the alignment template 62 from the inner hoop 36. The lifters 70 are spaced such that they do not operably interfere with other elements of the apparatus 1 as hereinafter described.

The screen printing means 5 includes a frame 75 and a screen 77. The frame 75 is shaped and dimensioned substantially similarly to the inside dimensions of the inner hoop 36 such that the frame 75 is snugly slidably insertable in the inner hoop 36 such that the inner hoop 36 encircles and is substantially co-planar with the frame 75. The screen 77 is tautly and adhesively secured to a lower, planar face 79 of the frame 75. The frame 75 has a pair of handles 81 and 82 to assist with removal of the frame 75 from the inner hoop 36.

The alignment means 7, such as a platform 87, as shown in FIG. 1, provides a pair of substantially vertically oriented styluses 89 and 90 for individually aligning each of the outer hoops 38 relative to the platen 16. The platform 87 has a pair of parallel guide rods 92 which are spaced along and parallel to the platen 16, which is spaced adjacent to the platform 87, as shown in FIG. 1. A guide block 94 is adapted to slide axially along the guide rods 92.

A stylus rod 96 is rigidly secured to the guide block 94 such that the stylus rod 96 moves parallel to the underlying platen 16 as the guide block 94 slides along the guide rods 92. The stylus 89 is rigidly spaced along the stylus rod 96 such that the stylus 89 successively describes the desired location of the x-axis 66 of one of the alignment templates 62 inserted in each one of the clamping means 18 mounted on the platen 16 as the guide block 94 is slidably displaced along the guide rods 92.

Similarly, the stylus 90 is rigidly spaced along the stylus rod 96 such that the stylus 90 successively locates an off-center point of a desired location of the y-axis 64 of one of the alignment templates 62 inserted in each one of the clamping means 18 as the stylus 89 locates the respective intersection 69 of the alignment template 62.

Figure 7:
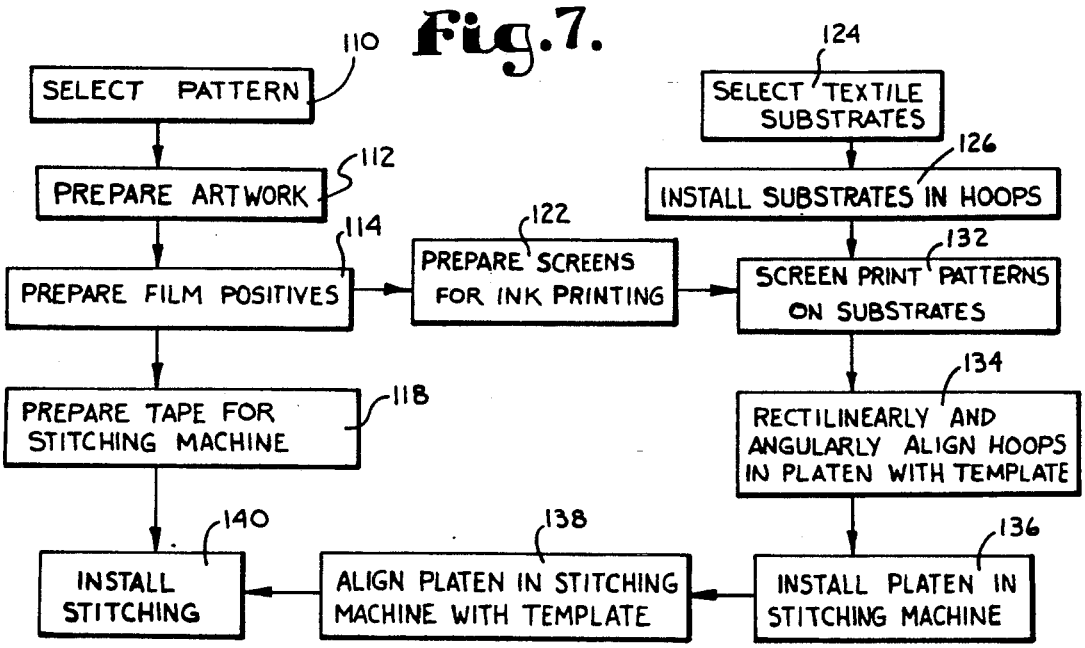
FIG. 7 is a schematic diagram of an application of the combination embroidery/screen printing apparatus.

In use, a pattern to be reproduced on the substrate 34 is selected, as indicated by the numeral 110 in FIG. 7. Artwork (not shown) for the reproduction 40 is then prepared, as indicated by the numeral 112, which is then reduced to a series of cooperating film positives (not shown), as indicated by the numeral 114, by methods and techniques commonly known in the art. Such film positives which were prepared for a stitched or embroidered portion 116 of the reproduction 40 is translated into a custom program punched into one of the tapes 23, as indicated by the numeral 118; such programming services are readily available in the industry. A negative of each such film positive which was prepared for a screen printed portion 120 of the reproduction 40 is photographically produced on a different one of the screens 77, as indicated by the numeral 122, by techniques and methods commonly known in the art.

Each of the substrates 34, such as a jacket, a sweatshirt, sheet material, and the like, which is to receive one of the reproductions 40 provided by the present invention, is selected and installed between one of the outer hoops 38 and one of the inner hoops 36, as indicated by the numerals 124 and 126, respectively. Substrates 34 having a tubular configuration similar to that of a sweatshirt or jacket must either be stitched with a tubular-type stitcher (not shown) or be installed such that the stitching machine 12 does not undesirably stitch different portions thereof together, such as stitching the front to the back. Where the substrate 34 is sheet material for receiving a plurality of the reproductions 40 thereon, such sheet material is appropriately installed in a plurality of the outer hoops 38 and the inner hoops 36 in spaced, side-by-side relation, as shown in FIGS. 1 and 3.

For those applications requiring precise location or orientation of the reproduction 40 on the substrate 34, a target disk 128 is used. The target disk 128 is constructed of thin flexible material, such as paper or the like. The target disk 128 has a pair of axes 130 which cross perpendicularly at an intersection 131 on one face thereof and has a pressure-sensitive adhesive or the like on the other face. The target disk 128 is then removably secured to the substrate 34 such that the intersection 131 locates the desired designated center for the reproduction 40 and one of the marks 130 designates the desired vertical orientation of the reproduction 40. When using the target disk 128, one of the templates 62, which is transparent, is then inserted in the inner hoop 36 and the substrate 34 is shifted relative to the inner hoop 36 and the outer hoop 38 until the marks 130 align with the respective axes 64 and 66, as viewed through the template 62. The clamping adjuster 46 is then adjusted to tighten the outer hoop 38 against the inner hoop 36 such that the substrate 34 is tautly secured therebetween. The template 62 is then removed from the inner hoop 36 and the target disk 128 is removed from the substrate 34.

Each of the frames 75 secured to a different one of the photographically prepared screens 77 is sequentially inserted in each of the inner hoops 36 and the screen printed portion 120 of the reproduction 40 transferred to the substrate 34 with a squeegee 76, or other suitable device, and selected inks (not shown), as indicated by numeral 132 and by techniques and methods commonly known in the art.

Each of the clamping means 18 is then secured to the platen 16 and one of the templates 62 is inserted, either concurrently or sequentially, in each one of the respective inner hoops 36. Then, the alignment means 7 is sequentially spaced relative to each of the clamping means in such that, by manipulating the respective knobs 51 and 53 and by physically shifting the clamping means 18 relative to the platen 16, the stylus 89 is substantially precisely aligned with the respective intersection 69 of the axes 64 and 66 as the stylus 90 is simultaneously substantially precisely aligned with an off-center point of the respective axes 64 such that each of the clamping means 18 is rectilinearly and angularly aligned with the platen 16, as indicated by numeral 134.

The platen 16, together with the aligned clamping means 18 rigidly secured thereto and the respective substrates 34 rigidly secured therein, is then appropriately installed in the stitching machine 12, as indicated by the numeral 136, such that the platen 16 in conjunction with the stitchers 14 is controlled and driven by the computer 27.

Then, the needle 29, or other suitable pointer, of a respective one of the stitchers 14 situated above one of the clamping means 18, secured to the platen 16 and containing one of the templates 62, is set at "center" and the stitching machine 12 is adjusted whereby the needle 29 is superimposed substantially directly above the intersection 69 of the axes 64 and 66 of the respective template 62, as indicated by the numeral 138.

Finally, the templates 62 are removed from the respective inner hoops 36 and the stitched portions 116 of the reproduction 40 are installed pursuant to the programming of the punched tape 23, as indicated by the numeral 140. As the installation of the stitched portions 116 are generally the most time consuming factor of producing the reproductions 40, another one of the platens 16, together with aligned clamping means 18 and screen printed substrates 34 therein, are prepared, ready for prompt installation in the stitching machine 12 after completion of the stitched portions 116 currently being installed therein, thereby more fully utilizing the available operating time of the stitching machine 12.

It is to be understood that while certain forms of the present invention have been illustrated and described herein, it is not to be limited to the specific forms or arrangement of parts described and shown.

What is claimed and desired to be secured by Letters Patent is as follows:

1. A combination stitching/screen printing apparatus for forming a reproduction of a pattern on a textile substrate, said reproduction having first portions thereof formed by screen printing and second portions thereof formed by stitching, comprising:

(a) clamping means for constraining said substrate as said reproduction is formed thereon;

(b) printing means for forming said printed first portions of said reproduction on said substrate;

(c) stitching means for forming said stitched second portions of said reproduction on said substrate; and (d) alignment means for aligning said clamping means with respect to stitching in such that registration is obtained between said printed first portions and said stitched second portions of said reproduction.

2. The combination stitching/screen printing apparatus according to claim 1 wherein said clamping means include:

(a) an inner hoop on one side of said substrate; said inner hoop having a non-circular configuration; and (b) an outer hoop on the other side of said substrate; said outer hoop encircling and substantially co-planar with said inner hoop with said substrate clamped therebetween.

3. The combination stitching/screen printing apparatus according to claim 2 wherein said alignment means include:

(a) an alignment template formed and dimensioned such that said alignment template is snugly slidably removably insertable in said inner hoop such that said alignment template is substantially co-planar with said inner hoop; said alignment template having a y-axis indicium for establishing a desired vertical orientation of said alignment template and an x-axis indicium perpendicularly intersecting said y-axis indicium at a mid-point thereof.

4. The combination stitching/screen printing apparatus according to claim 2 wherein said printing means include:

(a) a frame having a screen tautly and adhesively secured to an underlying face of said frame; said frame formed and dimensioned such that said frame is snugly slidably removably insertable in said inner hoop such that said screen is in substantially face-to-face abutting relationship with said substrate clamped between said inner hoop and said outer hoop.

5. The combination stitching/screen printing apparatus according to claim 3 including:

(a) a platen for mounting at least one of said clamping means thereon; said platen mountable on, and controllable by, said stitching means;

(b) an alignment platform; and (c) a first stylus and a second stylus oriented substantially vertically and suspended from said alignment platform; said first stylus and said second stylus cooperatively slidably displaceable along said platen such that said first stylus describes a centrally situated x-axis across the midpoint of a clamping means mounted on said platen and said second stylus locates an off-center point of a centrally situated y-axis of said clamping means as said first stylus is directly over the intersection of said described x-axis and said y-axis.

6. The combination stitching/screen printing apparatus according to claim 3 including:

(a) a target disk having a pair of centrally located, perpendicularly intersecting indicia inscribed on a face of said target disk; said target disk removably adhesively secured to said substrate such that said intersecting indicia locates the designated center of said substrate area to receive said reproduction; and (b) said alignment template being transparent.

7. A combination embroidery/screen printing apparatus for forming a plurality of reproductions of a selected pattern on at least one textile substrate, comprising;

(a) a plurality of inner hoops for spacing on a first side of said substrate; each said inner hoop having a rigid, continuous, substantially planar, non-circular configuration with inside dimensions greater than corresponding dimensions of each said reproduction of said pattern;

(b) a plurality of outer hoops for spacing on a second side of said substrate; each said outer hoop having a rigid configuration substantially similar to that of each said inner hoop; each said outer hoop having inside dimensions such that each said outer hoop substantially co-planarly encircles a respective one of said inner hoops when in a clamping relation therewith; each said outer hoop having a first mounting bracket with a transverse slot and a second mounting bracket with a longitudinal slot;

(c) a frame having a screen tautly and adhesively secured to a planar face thereof for screen printing a first portion of each said reproduction of said pattern on said substrate; said frame shaped and dimensioned such that said frame is snugly slidably removably insertable in each said inner hoop such that said inner hoop substantially encircles said frame and such that said screen is placed in face-to-face abutting relationship with said substrate clampingly confined by said inner hoop in clamping relation with a respective one of said outer hoops;

(d) a programmable, automated embroidery machine having a plurality of stitchers for simultaneously stitching a second portion of each said reproduction of said pattern into said substrate;

(e) a platen for mounting said plurality of said outer hoops in side-by-side relationship thereon; said platen mountable in, and controllable by, said embroidery machine;

(f) a least one planar, alignment template; said alignment template shaped and dimensioned such that said alignment template is snugly slidably removably insertable in each said inner hoop such that said inner hoop substantially encircles said alignment template; said alignment template having centrally located x-y axes inscribed on a face thereof such that one of said axes, as aligned, defines the desired vertical orientation of said reproductions of said pattern and the intersection of said x-y axes, as aligned, defines the desired designated center of said reproductions of said pattern; said alignment template having at least one lifter to assist with removal of said alignment template from a respective one of said inner hoops; and (g) an alignment platform for spacing adjacently to said platen; said alignment platform having a pair of parallel spaced guide rods, a stylus rod extending transversely from said guide rods, and a first stylus and a second stylus extending substantially vertically downwardly from said stylus rod such that, as said first stylus is spaced directly above said intersection of said x-y axes of an aligned one of said alignment templates inserted in one of said outer hoops mounted on said platen, said second stylus locates an off-center point of the desired orientation of said y-axis relative to said intersection of said x-y axes; said stylus rod slidably displaceable along said guide rods such that said first stylus and said second stylus are similarly, sequentially displaceable relative to one of said alignment templates inserted in each of the other said inner hoops clamped in a respective one of said outer hoops mounted on said platen.

8. A method for forming a reproduction of a pattern on a textile substrate comprising the steps of:

(a) selecting a textile substrate;

(b) installing a substrate in non-circular clamping means;

(c) selecting first portions of said reproduction of said pattern to be formed by screen printing and second portions of said reproduction of said pattern to be formed by stitching;

(d) preparing first artwork corresponding to said first portions and second artwork corresponding to said second portions;

(e) preparing at least one first film positive corresponding to said first artwork and at least one second film positive corresponding to said second artwork;

(f) preparing a framed screen from each said first film positive;

(g) sequentially inserting each said framed screen in said clamping means, respectively screen printing said first portions of said reproduction of said pattern on said substrate, and respectively removing each said framed screen from said clamping means;

(h) mounting said clamping means on a platen, and aligning said clamping means relative to said platen with an alignment template inserted in said clamping means;

(i) mounting said platen in an automated stitching machine and aligning said platen relative to said stitching machine with said alignment template inserted in said clamping means and then removing said alignment template; and (j) stitching said second portions of said reproduction of said pattern into said substrate.

9. The method according to claim 8 wherein step (b) includes:

(a) aligning said substrate relative to said clamping means with an alignment template in conjunction with a previously affixed target disk having alignment indicia thereon and then removing said target disk from said substrate.

10. The method according to claim 8 wherein step (h) includes:

(a) aligning said clamping means relative to said platen with an alignment platform having a first stylus and a second stylus, each substantially vertically oriented, such that said first stylus is directly over the origin of centrally located x-y axes inscribed on said alignment template as said second stylus is directly over an off-center portion of said y-axis.

* * * * *